US005742942A

United States Patent [19]

Sykes

[11] Patent Number: 5,742,942

[45] Date of Patent: Apr. 28, 1998

[54] GOLF GLOVE HAVING CLUB-GRIPPING STRAP

[76] Inventor: Philip K. Sykes, 5865 Fernwood St., Shoreview, Minn. 55126

[21] Appl. No.: 698,777

[22] Filed: Aug. 16, 1996

Related U.S. Application Data

[63] Continuation of Ser. No. 317,019, Oct. 3, 1994, abandoned.

[51] Int. Cl.[6] ..... A41D 19/00

[52] U.S. Cl. ..... 2/161.4; 2/161.2

[58] Field of Search ..... 2/161.4, 161.2, 2/161.1, 160, 159, 162

[56] References Cited

U.S. PATENT DOCUMENTS

| | | | |
|---|---|---|---|
| Re. 31,538 | 3/1984 | Antonious | 2/161.2 |
| 2,852,779 | 9/1958 | Roessler | 2/161.2 |
| 3,105,972 | 10/1963 | Christopher | 2/161.2 |
| 3,348,238 | 10/1967 | Hydock | 2/161.2 |
| 3,532,344 | 10/1970 | Masstab | 2/160 X |
| 3,918,097 | 11/1975 | Mlodoch | 2/161.1 |
| 5,022,094 | 6/1991 | Hames et al. | 2/161.1 X |
| 5,033,120 | 7/1991 | Myers | 2/161.4 X |
| 5,088,122 | 2/1992 | O'Toole | 2/161.4 |
| 5,184,353 | 2/1993 | Goldwitz | 2/161.4 |

FOREIGN PATENT DOCUMENTS

| | | | |
|---|---|---|---|
| 6079029 | 3/1994 | Japan | 2/161.2 |

*Primary Examiner*—Michael A. Neas
*Attorney, Agent, or Firm*—Leonard Tachner

[57] ABSTRACT

A golf club having a configuration adapted to ensure that the gloved, weak hand of the golfer, grasps the club shaft and particularly the gripping area thereof with a sufficient force to adequately secure the club and thus play the game despite the presence of a handicap, including a handicap comprising the total inability to exert any force in a gripping manner. Furthermore, the present invention provides a golf glove configuration which is designed to provide a powerful grasp of the club shaft with the gloved hand for preventing any twisting of the glove upon impact with the ball, despite the presence of large torquing forces resulting from such impact. The invention is essentially identical in shape to all existing golf gloves, but comprises a Velcro hooked strap which is much longer than the conventional Velcro hook strap found in ordinary golf gloves. Furthermore, the golf glove provides surfaces of Velcro loops on the knuckle side of the small finger and of the ring finger, which loops are designed to engage the elongated hook strap in a configuration during grasping. Such engagement locks the weak hand of the golfer around the gripping portion of the golf club shaft in a highly forceful manner which may exceed the inherent capability of the hand musculature.

10 Claims, 3 Drawing Sheets

GOLF GLOVE HAVING CLUB-GRIPPING STRAP

This is a continuation of application Ser. No. 08/317,019 filed on Oct. 3, 1994 now abandoned.

BACKGROUND OF THE INVENTION

1. Field of the Invention

The present invention relates generally to the field of sport gloves and more particularly to a golf glove which is configured to force the hand on which it is installed into a grasping relationship with the grip portion of a golf club during the address and swing of the club for striking a golf ball.

2. Prior Art

The use of a glove by golfers is well-known in the modern game of golf. Typically one golf glove is worn on the hand of the weaker arm, that is a right-handed golfer wears a left-handed golf glove and a left-handed golfer wears a right-handed golf glove. Usually the hand of the stronger arm is gloveless. The golf glove is designed to protect the surfaces of the hand on which it is worn to obviate the otherwise substantial likelihood of irritation and blistering that may occur after many balls are hit, such as during a full 18 hole golf game or while practicing by hitting a large plurality of golf balls at a driving range or the like. Despite the use of a golf glove, the golfer must still grasp the club grip portion with his gloved hand in a firm manner, relying on the muscles in the hand and forearm to create a sufficiently strong grip so that the golf club does not twist upon impact with the ball. Impact which is away from the sweep spot of the club head, creates a torque, tending to twist the club shaft in the golfer's hands. Such inadvertent twisting can change the orientation of the face upon impact with the ball and produce an inaccurate shot which goes left or right of the intended trajectory depending upon the direction to which the club is twisted by the impact of the ball.

Playing golf requires that the golfer's hand and forearm muscles create enough gripping force with the club to allow swinging action and impact with the ball. Those men and women who have a handicap, such as an injury or a diseased-induced reduction in the strength of the weaker hand, may simply be unable to play golf, lacking the requisite degree of gripping power to ensure the appropriate use of the club during the swing and impact with the ball.

An appropriately configured golf glove can provide even a handicapped individual with the appropriate gripping force to enable such individual to play golf. Furthermore, a golf glove configured properly in accordance with the present invention can also provide a unique training aid, providing an enhanced gripping force which makes it virtually impossible for the club to twist, even upon the occurrence of significant levels of torque due to twisting because of impact with the ball at the head of the club, away from the sweep spot thereof.

There is therefore a need for a golf glove which can be used to enhance or entirely provide the requisite degree of gripping power in the weak hand used in grasping the club for either handicapped people or people who wish to overcome the twisting of the club during training or actual play of the game.

SUMMARY OF THE INVENTION

The present invention meets the aforementioned need by providing a golf club having a configuration adapted to ensure that the gloved, weak hand of the golfer, grasps the club shaft and particularly the gripping area thereof with a sufficient force to adequately secure the club and thus play the game despite the presence of a handicap, including a handicap comprising the total inability to exert any force in a gripping manner. Furthermore, the present invention provides a golf glove configuration which is designed to provide a powerful grasp of the club shaft with the gloved hand for preventing any twisting of the club upon impact with the ball, despite the presence of large torquing forces resulting from such impact and thus can provide an advantageous training aid for golfers as well.

In a preferred embodiment disclosed herein, the golf glove of the invention is essentially identical in shape to all existing golf gloves, but is unique in that it comprises a Velcro hooked strap which is much longer than the conventional Velcro hook strap found in ordinary golf gloves. Furthermore, the golf glove of the present invention provides surfaces of Velcro loops on the knuckle side of the small finger and of the ring finger, which loops are designed to engage the elongated hook strap in a configuration during grasping in a manner to be disclosed herein. Such engagement forces and locks the weak hand of the golfer around the gripping portion of the golf club shaft in a highly forceful manner which may exceed the inherent capability of the hand musculature.

OBJECTS OF THE INVENTION

It is therefore a principal object of the present invention to provide a golf glove having a club-gripping strap for totally encircling the gripping portion of the golf club and locking the hand in a gripping position around that portion so that even golfers with decreased hand strength or other similar handicaps can still play the game of golf.

It is another object of the present invention to provide an improved golf glove which may be advantageously used as a training aid to enhance the golfer's grasp of the club, thereby preventing club twisting during impact of the ball that may otherwise occur due to a torque incurred in an off-center hit.

It is still another additional object of the present invention to provide a golf glove having Velcro fastening means to force the hand upon which the glove is worn to encircle the club shaft gripping portion in a forceful manner and in a conventional gripping configuration, whereby even an individual having virtually no strength in his gloved hand can play a game of golf.

BRIEF DESCRIPTION OF THE DRAWINGS

The aforementioned objects and advantages of the invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 2:
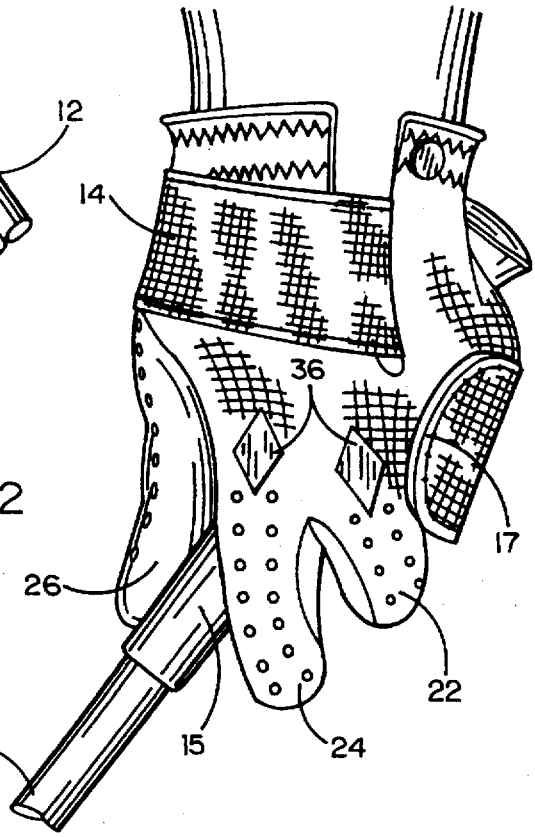
FIG. 2 is a view similar to that of FIG. 1, but showing the golf glove from the knuckle side of the golfer's hand.
Figure 3:
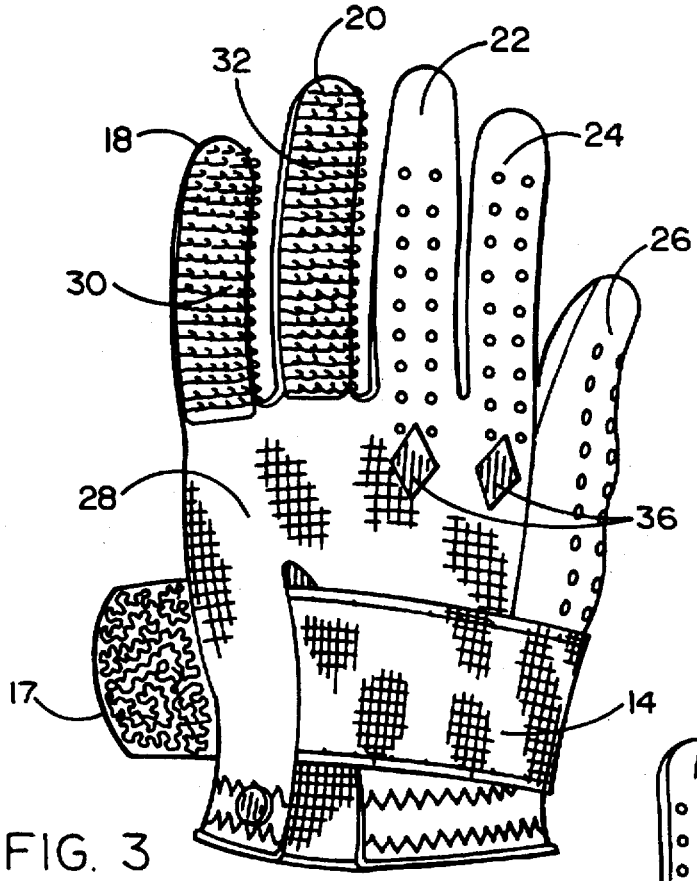
FIG. 3 is a knuckle-side view of the golf glove of the present invention, showing the glove in its unfolded configuration with the elongated strap thereof, wrapped around the glove in a conventional manner.
Figure 4:
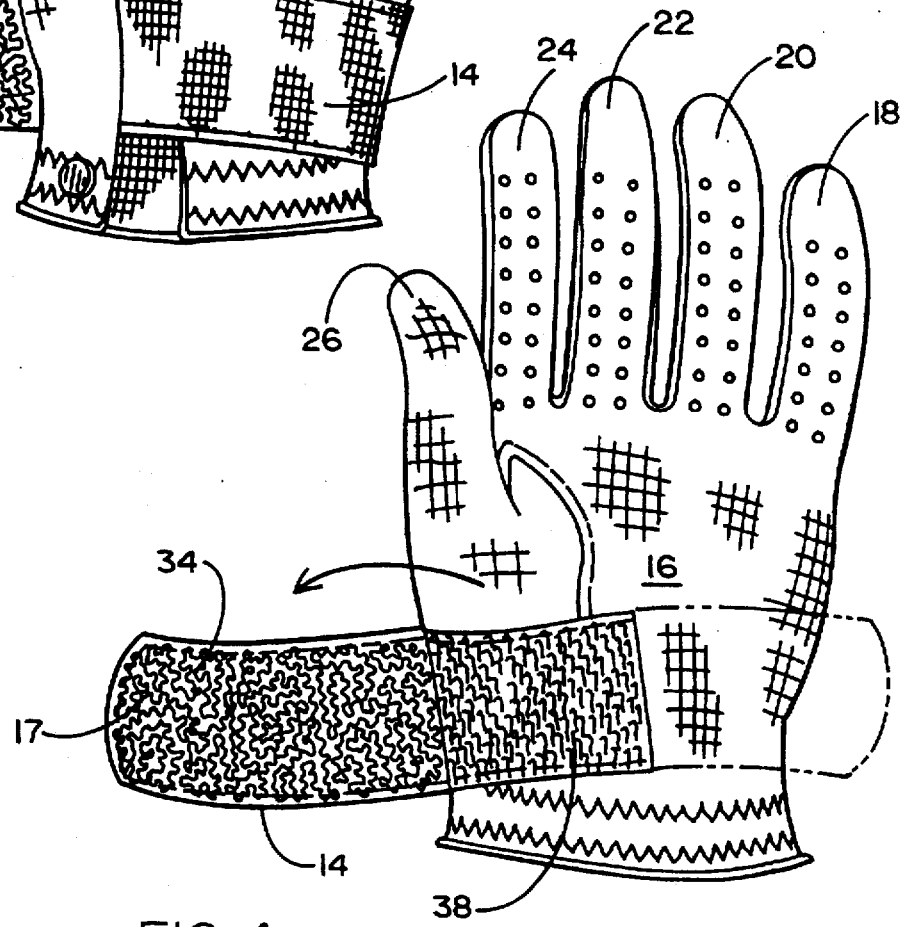
FIG. 4 is a palm-side view of the glove of the present invention shown in its unfolded configuration with the strap portion thereof shown partially wrapped around the glove.
Figure 5:
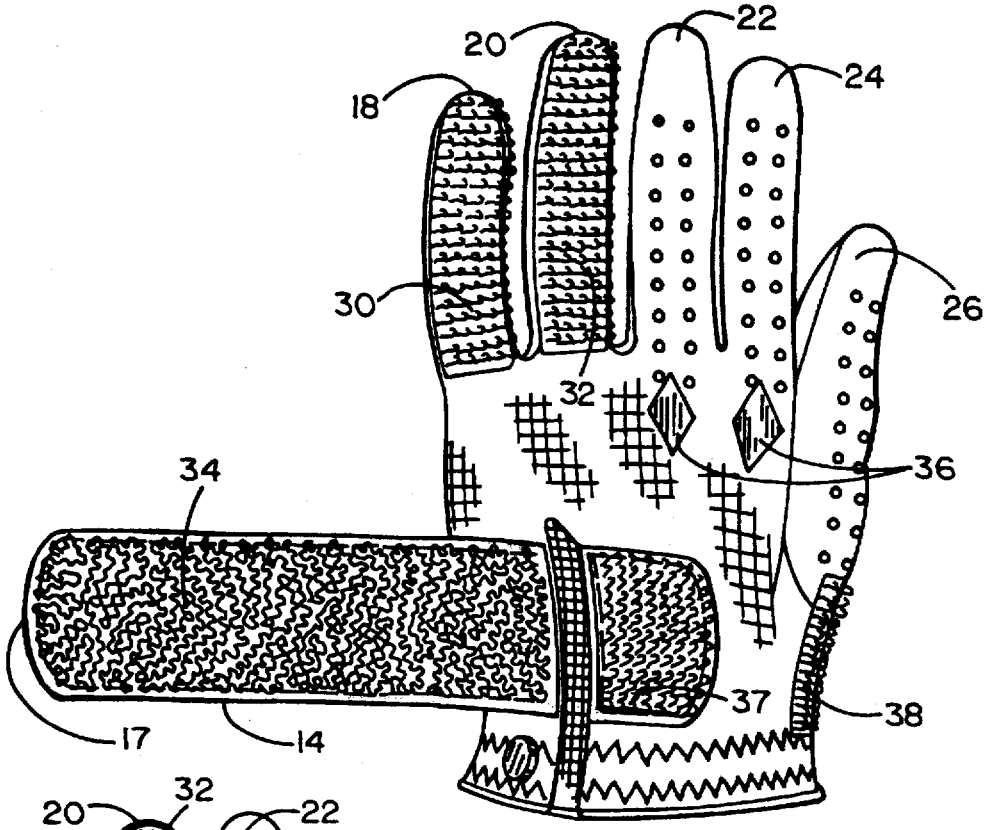
FIG. 5 is a knuckle-side view of the golf glove of the present invention showing the strap thereof in its totally unwrapped configuration.
Figure 6:
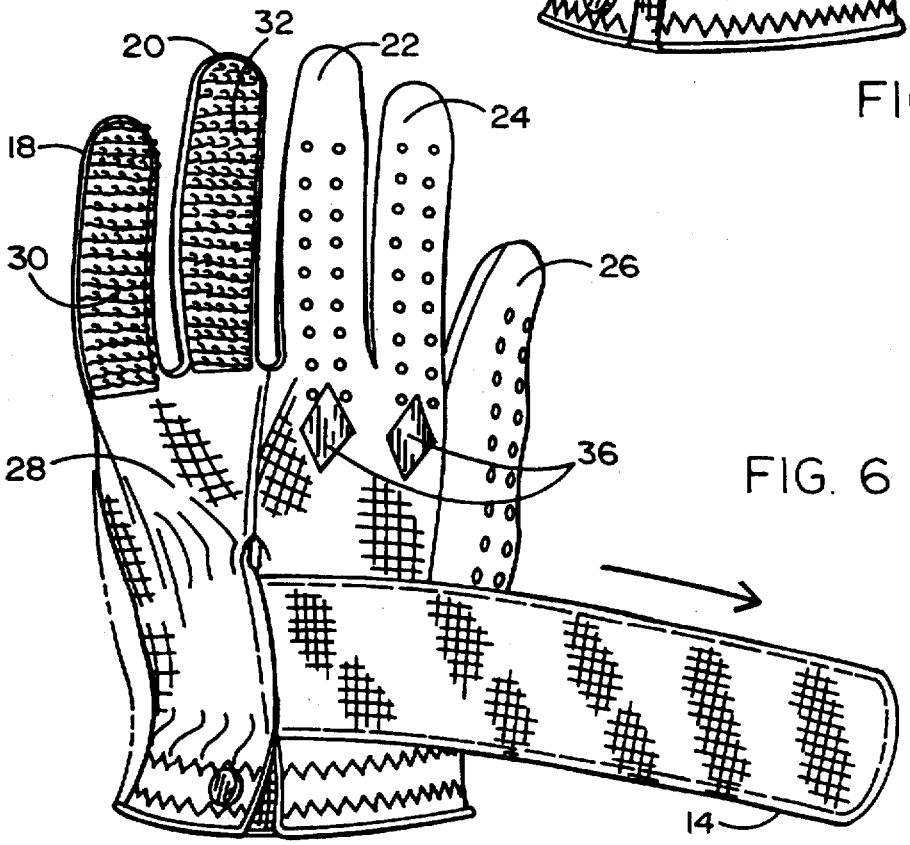
FIG. 6 is a knuckle-side view of the glove of the present invention shown with the strap thereof configured for closing the glove on the hand, but without interconnecting the fingers in the manner shown in FIGS. 1 and 2.

Referring now to the accompanying figures, it will be seen that a golf glove 10 is worn on the hand of a golfer, which in turn is in a grasping relationship to a golf club 12. That grasping relationship is implemented by means of a strap 14, the latter fully encircling the palm side of the golf glove, securing the grip 15 of the golf club 12, between the strap 14 and the glove palm-side surface 16. This configuration is achieved in the present invention by using an elongated strap 14 which is wound diagonally or helically around the glove until the strap end 17 seen in FIG. 2 is secured to the knuckle side of the smaller two fingers of the glove in a manner to be described hereinafter.

Figure 1:
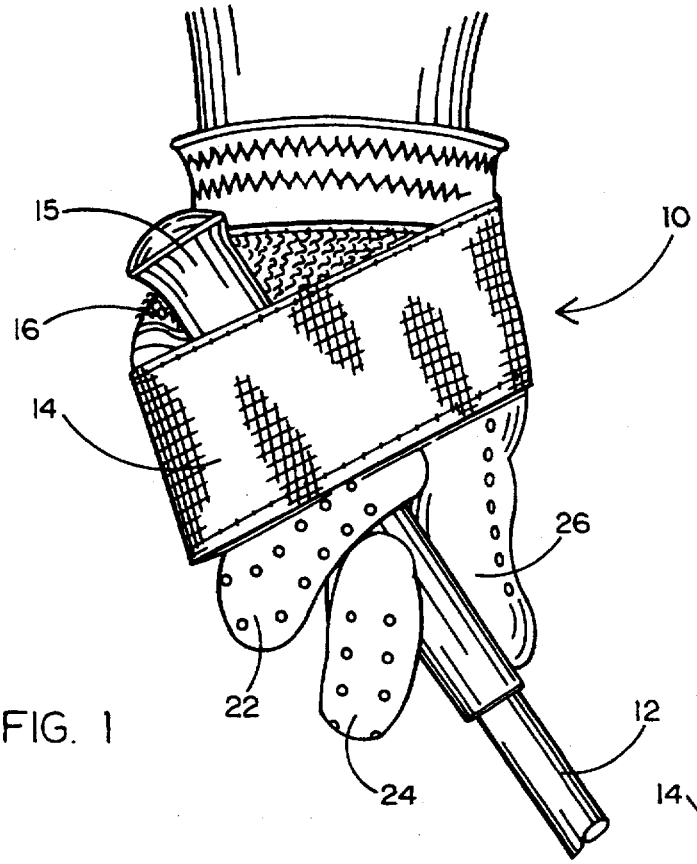
FIG. 1 illustrates the use of the golf glove of the present invention in a palm-side elevational view with the glove in its gripping configuration.

Reference will now be made to FIGS. 3–6 which illustrate the golf glove of the present invention in various configurations, particularly with respect to the position of the strap 14 in regard to the rest of the glove 10. As seen in those figures, the glove 10 of the present invention is conventional in some respects. More specifically, like other golf gloves, it is a fully enclosed glove comprising a full five finger configuration, including small finger 18, ring finger 20, middle finger 22, forefinger 24 and thumb 26. However, unlike more conventional golf gloves, the glove 10 of the present, provides a strap 14 which serves a dual purpose. More specifically, in addition to the purpose of closing a slit of the glove on the golfer's hand, as is usual for golf glove straps of the type normally seen in use by golfers, the greatly elongated nature of the strap 14 of the present invention also provides an additional new capability. That capability is that of configuring the golf glove while it is worn by the user, into the configuration shown in FIGS. 1 and 2. This feature is accomplished not only by the extraordinary length of the strap 14, but also by the use of a region of Velcro loops on the knuckle side 28 of the small finger 18 and the ring finger 20. More specifically, as seen best in FIGS. 3, 5 and 6, a region of Velcro loops 30 is applied to the knuckle side of small finger 18 and a region of Velcro loops 32 is applied to the knuckle side of ring finger 32. Strap 14 is conventional in that it has a large plurality of Velcro hooks 34, which are adapted to mate with and lock with the Velcro loops such as those just described as being on the knuckle side of the small finger 18 and ring finger 20. Velcro hooks 34 on strap 14 are also designed to engage and lock Velcro loops 38 which are predominantly on the palm side 16 of the glove 10 and Velcro loops 37 which are primarily on the knuckle side 28 of the glove 10, predominantly adjacent the wrist portion thereof.

The Velcro loops 37 provide a conventional glove-closing function by locking into the Velcro hooks 34 at the base of strap 14, that is the portion of strap 14 that is opposite the end 17 thereof. However, the Velcro loops 38, as well as the regions of Velcro loops 30 and 32, respectively, on fingers 18 and 20, provide a unique function, no heretofore known in the prior art of golf gloves. More specifically, loops 38, 30 and 32, provide a vehicle for the strap 14 of the present invention to be locked into the configuration shown in FIGS. 1 and 2, whereby the grip 15 is securely grasped, particularly by the small fingers 18 and 20, as a result of the tightly wrapped strap 14 which is secured in place by the aforementioned Velcro loops. In a preferred embodiment of the present invention illustrated herein, an optional pair of alignment insignia 36, such as those diamond shaped insignias shown in FIGS. 2, 3 and 5 and 6, may be used to provide the golfer with a readily visual indication that his glove 10 is aligned properly with the golf club, during the address portion of his golf game. The insignias 36 permit the golfer to be sure that he has secured the club within the glove 10 in an appropriate position by means of the elongated strap 14 and the Velcro interconnections described above.

Thus it will be seen that the present invention provides a golf glove having a golf club gripping strap of an unusually elongated dimension, which when combined with appropriate fastening means, such as Velcro loops and hooks, the loops being positioned on the palm side of the glove, as well as on at least the small and ring fingers of the glove on the knuckle side thereof, permit the strap to be wound diagonally or helically around the glove, whereby a golf club may be secured in a tightly grasped configuration between the strap and the palm side of the glove. Thus, the present invention overcomes the problem associated with golfers having a handicap of a physical nature which precludes a voluntary, forceful grasping of the club by the gloved hand. Furthermore, the present invention provides a unique training accessory which permits the golfer to secure the club in the gloved hand, tightly enough to prevent the club from twisting as a result of torque imparted by impact with the golf ball outside the sweep spot of the golf club head. It should be understood that by wrapping the strap around the wrist portion of the glove, the glove may be used in a conventional manner.

Having thus described in a preferred embodiment of the present invention, it will now be apparent to those having skill in the art to which the present invention pertains, that various modifications and additions may be made to the invention. By way of example, the precise dimensions and shapes and fastening means disclosed herein, may be readily altered without reducing the significant advantages derived from use of the present invention. By way of further example, Velcro hooks and loops may be interchanged and other fastening devices may be used. Furthermore, the present invention may be used for holding tennis rackets or other sports equipment as well as golf clubs. Accordingly, all such modifications and additions are deemed to be within the scope of the claims appended hereto and their equivalents.

I claim:

1. An improved golf glove for enabling a golfer to firmly grasp the gripping portion of a golf club without the voluntary contraction of the muscles in the hand normally required to grasp an object; the glove having a palm side, a knuckle side, a wrist portion, a finger portion and a thumb portion, the latter having a plurality of fingers, the knuckle side having an opening slit adjacent the wrist portion; the improvement comprising:

an elongated strap having first hook and loop fasteners, said strap being attached to a knuckle side of said glove adjacent the wrist portion and being sufficiently long to substantially encircle said wrist portion, said elongated strap being secured on one end thereof to an edge of said knuckle side defining said opening slit; and at least one region of second hook and loop fasteners on a knuckle-side of at least one finger of said glove for receiving said strap in fastening engagement with said first hook and loop fasteners when said strap is diagonally wrapped around said glove in a grasping configuration;

at least one region of third hook and loop fasteners on said palm side of said glove adjacent said thumb portion for receiving said strap in fastening engagement with said first hook and loop fasteners; and, the direction of wrap of said strap effecting closure of said opening slit to secure said golf glove.

2. The improvement recited in claim 1 wherein said one region of second hook and loop fasteners is located on the knuckle side of the little finger of the glove.

3. The improvement recited in claim 1 wherein said one region of second hook and loop fasteners is located on the knuckle side of the ring finger of the glove.

4. The improvement recited in claim 1 wherein said glove comprises at least two regions of second hook and loop fasteners, one said region located on the knuckle side of the little finger of the glove and another said region located on the knuckle side of the ring finger of the glove.

5. The improvement recited in claim 1 wherein said glove comprises at least two regions of second hook and loop fasteners, one said region located on the knuckle side of a finger of said glove and another said region located on the palm-side of said glove adjacent said wrist portion.

6. A sports glove comprising:

a glove-shaped fabric enclosure having a palm side, a knuckle side, a wrist portion and a finger portion, the latter portion having five fingers including a thumb;

the knuckle-side wrist portion of said glove having an opening and closing slit defining opposing edge portions facilitating placement of said glove on a user's hand and removal of said glove therefrom;

an elongated strap attached to said glove on one side of said slit and hook and loop fastening components on said strap and the opposing side of said slit for securing said glove wrist portion on a user's wrist by said strap, said elongated strap secured to one of said opposing edge portions of said slit;

at least one additional hook and loop fastening component affixed to the knuckle side of at least one of said glove fingers, said strap being sufficiently long to partially encircle said palm side of said glove and attach to said additional hook and loop fastening component with said glove in a grasping position;

a further hook and loop fastening component affixed to said palm side of said sports glove adjacent said thumb portion for receiving said strap in fastening engagement; and, the direction of said strap in encircling said palm side effecting closure of said slit to secure said sports glove on the user's hand.

7. The glove recited in claim 6 wherein said additional hook and loop fastening component is affixed to a little finger of said glove.

8. The glove recited in claim 6 wherein said additional hook and loop fastening component is affixed to a ring finger of said glove.

9. The glove recited in claim 6 wherein there are at least two said additional fastening components, one said additional fastening component being affixed to a little finger of said glove and one said additional fastening component being affixed to a ring finger of said glove.

10. The glove recited in claim 6 comprising at least one insignia on said glove enclosure for aiding the user in alignment.

* * * * *